United States Patent [19]

Beigay et al.

[11] 4,402,769

[45] Sep. 6, 1983

[54] METHOD FOR IMPROVING THE DUCTILITY OF AUTOGENOUS WELDS IN UNSTABILIZED, FERRITIC STAINLESS STEEL COILS

[75] Inventors: Jack M. Beigay, Buffalo Township, Allegheny County; Paul T. Lovejoy, Penn Hills, both of Pa.

[73] Assignee: Allegheny Ludlum Steel Corporation, Pittsburgh, Pa.

[21] Appl. No.: 448,868

[22] Filed: Dec. 10, 1982

[51] Int. Cl.[3] ..... C21D 9/50

[52] U.S. Cl. ..... 148/12 EA; 148/12.4; 148/127

[58] Field of Search ..... 148/12 EA, 12.4, 127

[56] References Cited

U.S. PATENT DOCUMENTS

| | | | |
|---|---|---|---|
| Re. 28,494 | 7/1975 | Rowe | 148/12 EA |
| 2,772,992 | 12/1956 | Kiefer et al. | 148/127 |
| 3,997,374 | 12/1976 | Dill et al. | 148/127 |

*Primary Examiner*—W. Stallard

*Attorney, Agent, or Firm*—Patrick J. Viccaro

[57] ABSTRACT

After autogenous welding of coils of straight-chromium ferritic stainless steel, the weld area is heated to a temperature within the range of about 1325° to 1515° F. and water quenched from elevated temperatures to room temperature to improve the ductility of the weld area so that during subsequent cold rolling cracking of the weld area will be avoided.

3 Claims, No Drawings

METHOD FOR IMPROVING THE DUCTILITY OF AUTOGENOUS WELDS IN UNSTABILIZED, FERRITIC STAINLESS STEEL COILS

BACKGROUND OF THE INVENTION

In the manufacture of straight-chromium ferritic stainless steels such as AISI Types Nos. 430,434 and 436, it is a preferable practice after hot rolling to produce hot-band coils welded together at the coil ends to form a larger coil for use during subsequent cold rolling. The larger coil so-formed is desirable for large-capacity cold-rolling facilities. The preferred practice for joining hot-band coils is by autogenous welding, wherein no weld filler metal is used. This practice provides a chemical composition at the weld area that is the same as the remainder of the coil. It is not, therefore, necessary to locate and remove the weld portion upon completion of cold rolling. In large-capacity cold-rolling operations, larger hot-band coils of this type serve to reduce handling and processing costs.

It has been found, however, that with straight-chromium ferritic stainless steels upon autogenous welding of two coils during subsequent cold rolling, the weld area is brittle and thus this weld area of the coil cannot be passed over processing rolls incident to cold rolling. In addition, during cold rolling to finished gauge, the coils tend to break at the weld area. The brittleness of the weld area results from the formation of martensite, which is a hard and brittle phase, upon cooling from the elevated welding temperatures. To overcome this problem, it is known to subject the weld area of the coil to a tempering treatment to soften the brittle martensite much as in a similar manner that the coil was final or box annealed. Although tempering treatments sufficiently lower the ductile-brittle transition temperature (DBTT) for some lighter gauge strip materials below the conventional hot-band thickness, they are not sufficient for typical hot-band gauges. Even if the martensite is softened by tempering, the coils will, nevertheless, tend to break during cold rolling if the ductile-brittle transition temperature is at or above the average room temperature of about 70° to 75° F.

It is accordingly a primary object of the present invention to provide a post-weld treatment for autogenous welded hot-band straight-chromium ferritic stainless steel that will soften the martensite of the weld area and, in addition, improve the ductility and toughness so that cracking of the weld area is avoided during subsequent cold rolling to final gauge.

This and other objects of the invention as well as a more complete understanding thereof may be obtained from the following description and specific examples.

SUMMARY OF THE INVENTION

In accordance with the present invention, a method for improving the ductility of an autogenous weld in a hot band of straight-chromium ferritic stainless steel comprises heating the weld area to a temperature of about 1325° to 1515° F. (718.3° to 823.9° C.) for at least about 2 minutes and then rapidly cooling as water quenching from an elevated temperature of at least 1200° F. (648.9° C.) to room temperature. The ductility is improved by lowering the DBTT at or below room temperature.

DETAILED DESCRIPTION OF PREFERRED EMBODIMENTS

In the practice of the invention, after hot rolling and possibly box annealing, the chromium ferritic stainless steel coil ends are autogenously welded and the weld area is subjected to a conventional tempering heat treatment followed by rapid cooling, such as by water quenching, to room temperature. Specifically, the weld area is heated to a temperature within the range of about 1325° to 1515° F. (718.3° to 823.9° C.) for a period of about 2 minutes, and preferably about 2 minutes or more, and with a practical limitation of about 5 minutes. The heating step softens the martensite. The weld area is then water quenched from elevated temperature to room temperature to improve the ferrite toughness. Preferably, the quenching occurs from temperatures of at least 1200° F. (648.9° C.) at which the steel and weld area are red hot. It has been determined experimentally that this treatment lowers the ductile-brittle transition temperature (DBTT) and produces overall ductility sufficient that the cold rolling to conventional final gauge may be achieved without cracking or breaking of the weld area.

As a specific example to demonstrate the invention, conventional hot-rolled band of 0.220" gauge of AISI Type 430 ferritic stainless steel was subjected to plasma arc welding to form weld samples. The samples were heated for 5 minutes at 1400° F., and other samples of similar material were heated for 60 minutes at the same temperature. After heating, both the 60-minute and 5-minute heated samples were subjected to water quenching and air cooling from the 1400° F. temperature. The samples were then subjected to bend testing at the temperature set forth in Table I. As demonstrated, air-cooled welds could not be bent without suffering brittle fracture, whereas the water-quenched welds after both 5 and 60 minutes' heat treatment could be bent 180° successfully. Furthermore, the data shows that water-quenched welds were bendable at temperatures down to 50° F. (10° C.).

TABLE I

| Type 430 .220" Gauge HRB - Plasma Arc Weld | | | | |
|---|---|---|---|---|
| Bend Test Temperature | 5 - Min. Heat Treat | | 60 - Min. Heat Treat | |
| (1" Diam. Pin) | Air Cooled | Water Quench | Air Cooled | Water Quench |
| 70° F. | Broke | 2-Passed | 2-Broke | 2-Passed |
| 60° F. | — | 2-Passed | — | — |
| 50° F. | — | 2-Passed | — | — |
| 40° F. | — | 1-Passed, 1-Broke | — | — |
| 30° F. | — | Broke | — | — |
| 20° F. | — | Broke | — | — |
| 10° F. | — | Broke | — | — |
| 0° F. | — | Broke | — | — |

The symbol — means no data.

The bend test was conducted by bending a specimen 1-inch wide by 6-inches long by 0.220-inch thickness with the weld extending transverse to the specimen length into a female die. The male die had a radius of 2 times the specimen thickness and the specimens were bent a full 180°.

As may be seen from the results reported in Table I, the samples that were subjected to the 5-minute heat treatment followed by water quenching exhibited ductility greater than that of the samples heated for 5 or 60 minutes followed by air cooling. The samples heated for 5 minutes followed by water quenching did not break during bend testing at temperatures significantly below average room temperatures. It may be seen, therefore, that with post-weld heat treatment and water quenching of the invention, ductility sufficient to permit conventional cold rolling of welded hot-band material may be achieved.

Although water quenching is employed in accordance with the practice of the invention, it is understood that the term "water quenching" as used herein would refer to any quenching practice wherein the effectiveness of the quench would be comparable to or better than that achieved with conventional water quenching.

What is claimed is:

1. A method for improving the ductility of an autogenous weld in hot band of straight-chromium ferritic stainless steel to permit cold rolling to final gauge without weld cracking, said method comprising heating said weld to a temperature within the range of about 1325° to 1515° F. for at least about 2 minutes and water quenching from elevated temperatures of at least 1200° F. to room temperature.

2. The method of claim 1 wherein said heating is for about 2 or more minutes.

3. The method of claim 1 wherein said straight-chromium ferritic stainless steel is a steel selected from the group consisting of AISI Types 430, 434 and 436.

* * * * *